United States Patent [19]

Fritschi

[11] 4,313,268

[45] Feb. 2, 1982

[54] STRETCHING AND FOLDING APPLIANCE

[76] Inventor: Hermann Fritschi, Steinmürli, CH-8503 Hüttwilen, Switzerland

[21] Appl. No.: 122,933

[22] Filed: Feb. 20, 1980

[30] Foreign Application Priority Data

Mar. 2, 1979 [CH] Switzerland ..... 2050/79

[51] Int. Cl.[3] ..... D06F 71/40; D06C 3/08

[52] U.S. Cl. ..... 38/12; 24/248 R; 38/102.91; 223/DIG. 2

[58] Field of Search ..... 294/86 R, 8.5; 24/243 R, 248 R; 38/12, 13, 102, 102.91; 223/DIG. 2, 37, 38

[56] References Cited

U.S. PATENT DOCUMENTS

| | | | |
|---|---|---|---|
| 772,055 | 10/1904 | Post | 24/248 R |
| 1,727,200 | 9/1929 | Gillet | 24/248 R |
| 2,128,758 | 8/1938 | Prati | 223/DIG. 2 |
| 2,556,147 | 6/1951 | Pearson | 38/12 X |
| 2,689,996 | 9/1954 | Glattes | 223/DIG. 2 |
| 3,466,706 | 9/1969 | Asano | 38/102.91 X |

FOREIGN PATENT DOCUMENTS 609113 2/1979 Switzerland .

*Primary Examiner*—Louis Rimrodt
*Attorney, Agent, or Firm*—Pollock, Vande Sande & Priddy

[57] ABSTRACT

A stretching and folding clamping assembly for retaining a workpiece in a predetermined position, wherein a lower clamp arm is pivotally and displaceably mounted on a support bracket. An upper clamp arm is pivotally attached to the lower clamp arm and a pair of attached toggle levers are connected at one end to the support bracket and at a further end to the upper clamp arm. A spring assembly is attached to the support bracket and toggle arms for biasing the toggle arms and upper clamp arm into one of two stable positions, namely an open position wherein end portions of the upper and lower clamp arms are spaced from one another or a closed position wherein end portions of the clamp arms are adjacent one another. A locking mechanism is arranged between one of the clamp arms and the support bracket to retain the clamp arms in the closed, stable position until a desired opening movement of the clamping assembly is initiated.

16 Claims, 7 Drawing Figures

Fig.5
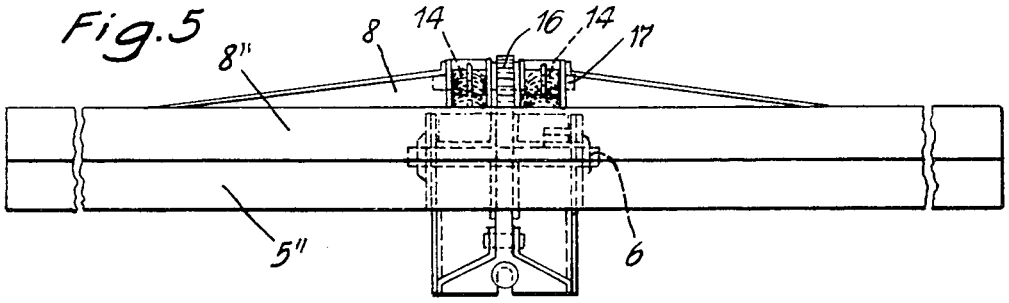
Fig.6
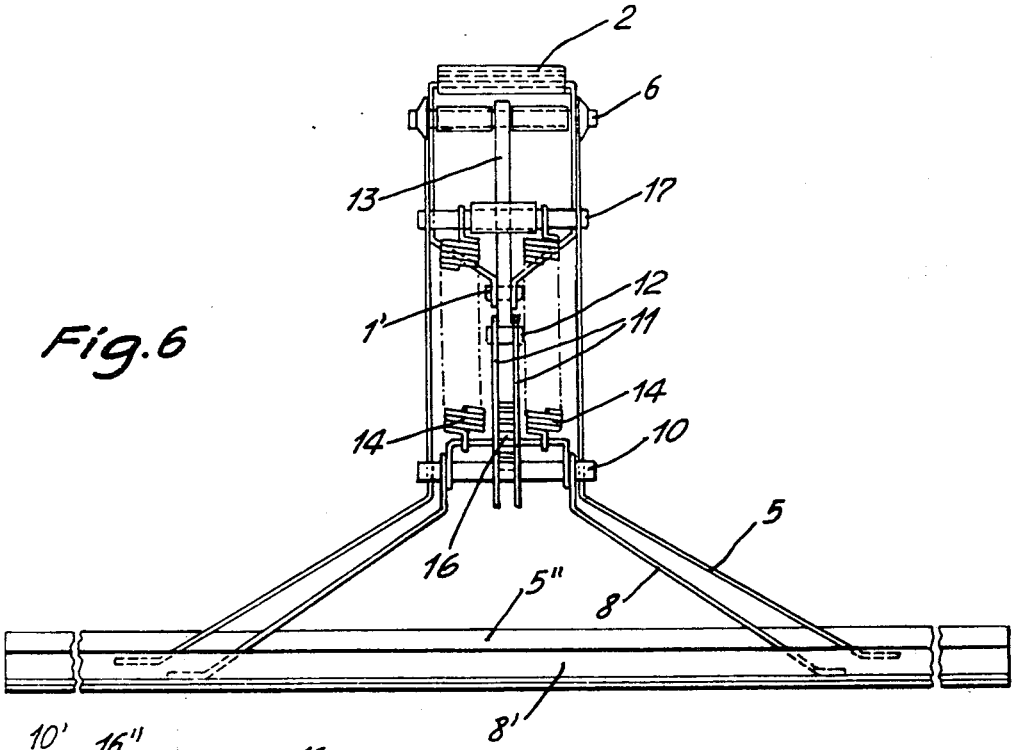
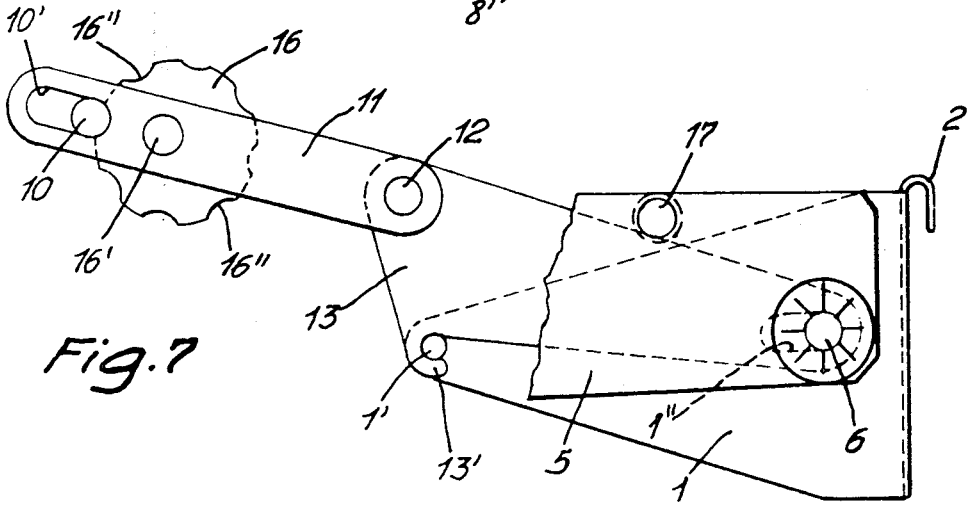
Fig.7

STRETCHING AND FOLDING APPLIANCE

BACKGROUND TO THE INVENTION

In known appliances for folding cloth-type workpieces, such as articles of laundry etc., the opening and closing of the associated clamping elements had to be effected by means of a protruding hand lever, which made operation and handling difficult. The opening of the clamping elements for withdrawal of the workpiece in the stretched condition was especially complicated, because then two hands were needed, namely one to hold the workpiece and the other to operate the lever. It was not possible to hold thicker and fine workpieces uniformly, since the possibility of precise adjustment of the clamping elements was lacking.

OBJECT OF THE INVENTION

Now in accordance with the invention by elimination of certain actuating elements it is posible to achieve not only a simplification of construction but also a facilitation of operation.

SUMMARY OF THE INVENTION

To achieve this aim a stretching and folding appliance is proposed which is distinguished in that the one pivotable clamp arm is also mounted displaceably in the bracket and means are provided to secure the clamp arms in the tightened and closed position and elements are provided for the displacement of the clamp strips defining the insertion opening.

BRIEF DESCRIPTION OF DRAWINGS

A preferred embodiment of an appliance is illustrated by way of example in the drawing, wherein

FIG. 5 shows a front view of the appliance with the clamping strips closed;

FIG. 6 shows a plan view of FIG. 5; and,

FIG. 7 shows a lateral elevation of the bracket with clamping arm, toggle lever and eccentric disc, on a larger scale.

DESCRIPTION OF PREFERRED EMBODIMENT

Figure 1:
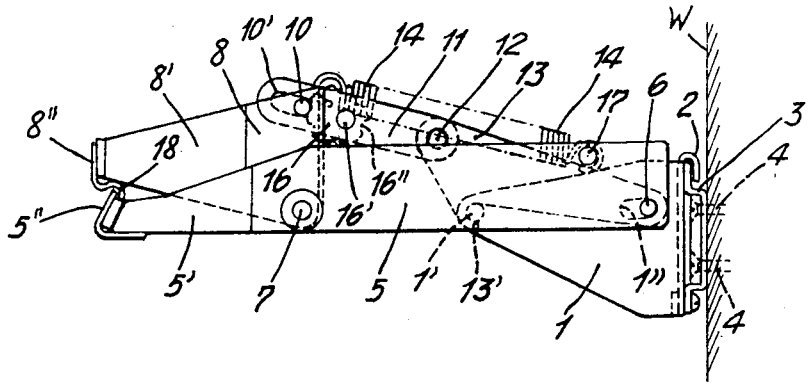
FIG. 1 shows a lateral elevation of the appliance in the closed, locked, clamping position.

Numeral 1 denotes a bracket suspended by means of attachment hooks 2 on a holder 3 secured by means of screws 4 on a wall W. As will become clear, bracket 1 forms, in known manner, the carrier for the appliance.

The holder 3 is secured by means of a screw clamp to a non-displaceable article 4 such as a door frame or table top. A lower clamp arm 5 carries a horizontal clamping strip 5'' of angle section type on the forward ends of its arm members 5' and is pivotably articulated about a horizontal pivot bolt 6 mounted in the bracket 1. The pivot bolt 6 is displaceably mounted in slots 1'' formed in the side members of the bracket 1 which has a U-shaped configuration as seen in plan view. The displacement distance formed by slots 1'' is somewhat greater than the diameter of the pivot bolt 6. An upper clamp arm 8, carries a horizontal clamp strip 8'' on the forward ends of its arm members 8' and is pivotably articulated on a pivot bolt 7 which penetrates the arm members 5' of the lower clamp arm 5. A lower edge of the upper clamp strip 8'' forms an arcuate part 18 having a downwardly open groove 9 engageable with the upper edge of the clamp strip 5''.

The opening and closing of the upper clamp strip 8'' in relation to the lower clamp strip 5'' are effected by the two-part toggle lever 11, 13, the rear end of which is articulatedly connected to the pivot bolt 6 of the bracket 1, and the forward end of which, engaging with a slot 10' on a joint bolt 10, is articulatedly connected by the latter with the clamp arm 8. The toggle lever part 11 carries an eccentric disc 16 adjustable in rotation about a bearing bolt 16', which disc has detents 16'' on the circumference and bears against the joint bolt 10 with a detent 16'' to be selected in each case. By rotation of the eccentric disc 16 the length of the lever arm of the toggle lever part 11 acting on the joint bolt 10, and thus the insertion opening 15 between the clamp strips 5'', 8'', can be adjusted within specific limits. Numeral 14 designates tension springs engaging at the front on the joint bolt 10 and at the rear on an attachment bolt 17 mounted on clamp arms, which springs attempt to pull the clamp arms 5, 8 into their open position (FIG. 2) when positioned on one side of the tipping point of the toggle lever 11, 13 and into their closed position (FIG. 1) when positioned on the other side of the tipping point. The toggle lever 13 is locked by means of a hook 13' on the lower left part (FIG. 7) to a transversely directed securing bolt 1' attached to bracket 1.

Figure 3:
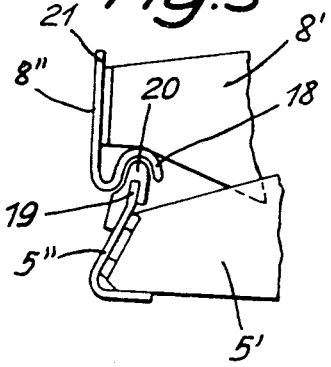
FIG. 3 shows an end view of the clamping strips with an elastic intermediate section to improve the clamping action in the case of fine workpieces, on a larger scale.
Figure 4:
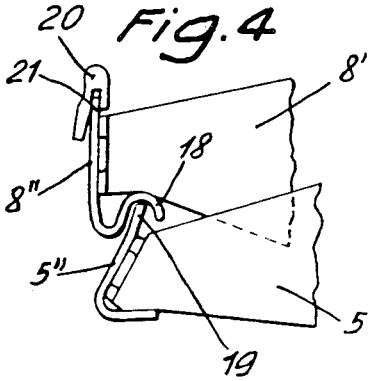
FIG. 4 shows the retention of the intermediate section when not in use.

To improve the clamping action of the clamping strips 5'', 8'' an elastic intermediate section 20, see FIGS. 3 and 4, can be removably inserted between the clamp strips 5'', 8'' and can be pushed on to an upwardly protruding flange portion 19 of the lower clamp strip 5''. This elastic intermediate section is expedient especially for use when workpieces of fine fabric are clamped in. In the case of workpieces of coarse fabric such as terry towels, blankets, table cloths, etc., the elastic intermediate piece 20 is often not required and can be pushed on to an upwardly protruding flange portion 21 of the upper clamp strip 8''.

As will be described in detail the opening and closing of the clamp arms 5 and 8 are effected in a conventional manner by upward and downward pivoting movement of the lower clamp arm 5.

In order to initiate the opening of the appliance the clamp arms 5, 8 are pushed out of the closed position (FIG. 1) toward the rear against the holder 3, while simultaneously lifting clamping arm 5, with the pivot bolt 6 shifting somewhat in the slots 1'' in the bracket 1. This pushing and lifting movement of clamp arm 5 can be effected by hand without releasing the workpiece (not shown separately) clamped between the clamp strips 5'', 8''. The clamp arms 5, 8 with the clamp strips 5'', 8'' are then brought into the position according to FIG. 2 and in fact the clamp strips 5'', 8'' are opened and the introduction of the workpiece (not shown) into the insertion opening 15 can be effected. Then the clamp arms 5, 8 are moved downwards by their forward sides, with the clamp strips 5'', 8'' being closed to clamp fast the workpiece introduced therebetween, due to the tension action of the springs 14. The work with the stretching and folding of the workpiece can then take place, in fact the stretching of the workpiece is commenced in that the workpiece is drawn forwards or to the left (FIG. 1). The clamp strips 5″, 8″ are drawn to the left when the displacement of the clamp arms 5, 8 is effected, the slots 1″ moving over the pivot bolt 6. The securing bolt 1′ then comes out of engagement with the hook 13′ and the movement connection with the toggle lever 13 no longer exists.

Figure 2:
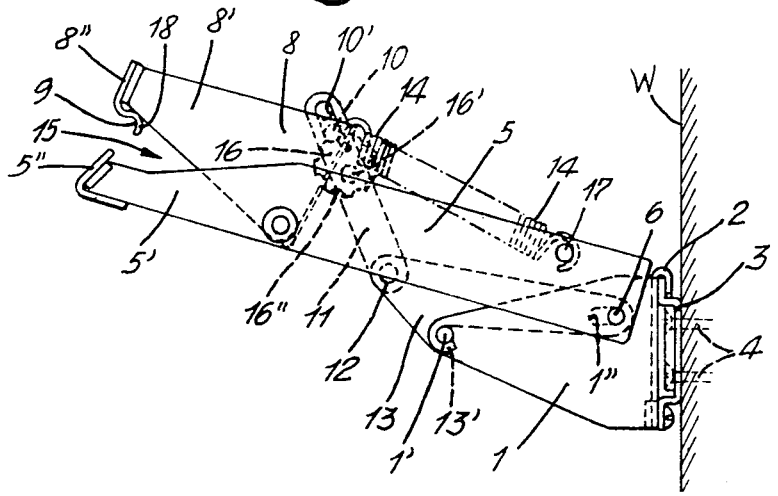
FIG. 2 shows a similar view with the clamping arms in the hinged-up, opened and locked position.

In the stretching of the workpiece it is usual to set it into swinging upward and downward movements at the same time; the clamp elements 5, 8, 5″, 8″ can in this case accompany the movements without undesired opening, if the hook 13′ is not in engagement with the securing bolt 1′. The clamp arm 5 carrying the clamp arm 8 can then rotate about the pivot bolt 6 without entraining the toggle lever 13. FIGS. 1 and 2 show only the positions in which the securing bolt 1′ is in engagement with the hook 13′ and entrains the toggle lever 13 in the pivoting of the clamp arms 5, 8. This however is not so when the clamp arms 5, 8 are drawn on to the region of the slots 1″ by the stretching of the workpiece forward or to the left. The unsecured position, when in fact the securing bolt 1′ does not lie in the hook 13′, is not shown separately in the drawings.

A securing bolt 1′ on the bracket 1 can be replaced by a plate or a transverse flange, which is expedient especially in the case of embodiments of synthetic plastics material.

The securing of the holder 3 on a wall or door can of course take place in a different manner, for example as shown in Swiss Patent of Addition No. 609,113. The retention 3 can however be effected equally by screwing fast, with the provision of one or more conventional dowels.

The appliance as described, as the result of absence of a relatively long operating lever and a long bracket, comprises no components which protrude substantially upwards or downwards; it is therefore relatively compact and can easily be equipped with a casing which wholly or partially covers the springs 14, the bracket 1, the toggle levers 11, 13 and the clamp arms 5, 8.

I claim:

1. In a stretching and folding appliance having clamp elements pivotable on a bracket for clamping in the workpiece, and toggle levers in working connection with these elements, which by springs about a spring tipping point hold and press the clamping elements into the clamping position, the provision of the one pivotable clamp arm being also displaceably mounted in the bracket and means are provided to secure the clamp arms in the tightened and closed position and elements are provided for the adjustment of the clamp strips which define an insertion opening.

2. An appliance according to claim 1, wherein the two-part toggle lever, movable about a spring tipping point, is mounted pivotably and displaceably with the pivot bolt, on which it is pivotable in the bracket, in the direction of the spring traction in slots of the bracket in such a way that automatic opening and closing of the insertion opening can be effected by upwardly or downwardly directed pressing of the clamp arms.

3. An appliance according to claim 1, wherein the toggle lever part carries an eccentric disc having detents on the circumference and bears with the eccentric disc adjustable in rotation about a pivot bolt, against the joint bolt of the upper clamp arm in such manner that by rotation of the eccentric disc the length of the toggle lever part acting on the joint bolt and thus the opening between the clamp strips can be adjusted.

4. An appliance according to claim 1, wherein the end part of the toggle lever part carrying the eccentric disc is guided by means of slots on the joint bolt of the upper clamp arm.

5. An appliance according to claim 1, wherein the toggle lever part is lockable on a securing bolt of the bracket by means of attachment hooks.

6. An appliance according to claim 1, wherein the clamp strip of the upper clamp arm has a downwardly protruding arcuate flange into the downwardly open groove of which an upwardly protruding flange of the lower clamp strip engages.

7. An appliance according to claim 6, wherein an elastic intermediate section is removably pushed on to the upwardly protruding flange of the lower clamp strip and renders possible secure clamping in of a fine workpiece.

8. An appliance according to claim 7, wherein the elastic intermediate section is profiled so that when not in use it can be pushed on to the upper longitudinal edge of the clamp strip.

9. A clamping assembly for retaining a cloth-like workpiece during stretching, folding or the like of said workpiece, and comprising:

a substantially U-shaped support bracket having a pair of aligned slots formed in opposite side-wall portions thereof, with a first pivot pin extending through and being displaceable within said aligned slots;

a pair of clamp arms including a first clamp arm having a first end portion surrounding a portion of said pivot pin and a second, oppositely disposed end portion remotely spaced from said pivot pin, said pair of clamp arms further including a second clamp arm having a first end portion aligned with and pivotally attached to an intermediate portion of said first clamp arm via a second pivot pin extending through aligned apertures formed in said first and second clamp arms, said second clamp arm further including a second end portion confronting said second end portion of said first clamp arm to define a clamping space therebetween; and toggle lever biasing means pivotally arranged between said second clamp arm and said support bracket for biasing said confronting end portions of said clamp arms toward one another when said toggle lever biasing means assumes a first pivotal relationship and for biasing said confronting end portions of said clamp arms away from one another when said toggle lever biasing means assumes a second, different pivotal relationship.

10. A clamping assembly according to claim 9, wherein said toggle lever biasing means includes locking means pivotally connecting a lever portion of said toggle lever biasing means to said support bracket for selectively preventing said lever portion from pivoting relative to said support bracket.

11. A clamping assembly according to claim 10, wherein said locking means comprises hook-shaped flange formed on said lever portion of said toggle lever biasing means and facing substantially in the direction of said U-shaped support bracket for selectively engaging a locking bolt extending outwardly from said support bracket to prevent said lever portion of said toggle lever biasing means from rotating relative to said bracket, causing a remaining lever portion of said toggle positions lever biasing means to pilot between first and second pivotal positions as said first clamp member is pivoted about said first pivot pin either toward or away from the remaining second clamp member.

12. A clamping assembly according to claim 9, wherein said toggle lever biasing means includes eccentric means for adjusting the biasing force against a portion of said toggle lever biasing means when in said first pivotal relationship to selectively adjust the clamping force exerted by said confronting end portions of said clamp members.

13. A clamping assembly according to claim 12, wherein said eccentric means comprises a disk eccentrically rotatably mounted on a portion of toggle lever biasing means, said eccentricly mounted disk abutting a pin member attached to said second clamp member, which pin member extends through a slot formed in said toggle lever biasing means, wherein the angular orientation of the eccentricly mounted disk serves to adjust the position of the pin member within the slot, thereby altering the effective lever arm of the toggle lever biasing means to alter the clamping pressure between the confronting end portions of the clamp arms.

14. A clamping assembly according to claim 9, wherein said toggle lever biasing means comprises a pair of separate toggle levers each having first and second oppositely disposed end portions, wherein the first end portion of one toggle lever is pivotally mounted on said first pivot pin, the second end portion of said toggle lever is pivotally attached to a first end portion of the remaining toggle lever and the second end portion of the remaining toggle lever includes a slot receiving a further pin member extending from said second clamp member.

15. A clamping assembly according to claim 14, wherein said toggle lever biasing means further comprises a spring assembly having a first end portion attached to a pin extending from said support bracket and having a second end portion attached to said further pin member attached to said second clamp member and extending through said slot formed in said remaining toggle lever, whereby said spring assembly biases said pair of toggle levers into one of said first and second positions to adjust the relative distance between the confronting end portions of said pair of clamp members.

16. A clamping assembly according to claim 9, wherein an elastomeric intermediate section is removably mounted on one of the confronting end portions of said clamp members.

* * * * *